US012768024B2

(12) United States Patent
Cetinkaya et al.

(10) Patent No.: US 12,768,024 B2
(45) Date of Patent: Oct. 20, 2026

(54) HOT-DIP GALVANISED STEEL SHEET

(71) Applicant: ThyssenKrupp Steel Europe AG, Duisburg (DE)

(72) Inventors: Burak William Cetinkaya, Dortmund (DE); Fabian Junge, Wesel (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 186 days.

(21) Appl. No.: 18/279,686

(22) PCT Filed: Mar. 18, 2022

(86) PCT No.: PCT/EP2022/057164

§ 371 (c)(1),
(2) Date: Sep. 5, 2023

(87) PCT Pub. No.: WO2022/207365

PCT Pub. Date: Oct. 6, 2022

(65) Prior Publication Data

US 2024/0133012 A1 Apr. 25, 2024
US 2024/0229210 A9 Jul. 11, 2024

(30) Foreign Application Priority Data

Mar. 29, 2021 (DE) ..... 10 2021 107 873.3

(51) Int. Cl.
*C23C 2/06* (2006.01)
*C23C 2/14* (2006.01)
*C23C 2/40* (2006.01)

(52) U.S. Cl.
CPC ..... *C23C 2/06* (2013.01); *C23C 2/14* (2013.01); *C23C 2/40* (2013.01)

(58) Field of Classification Search
None
See application file for complete search history.

(56) References Cited

U.S. PATENT DOCUMENTS

2004/0258949 A1* 12/2004 Honda ..... C22C 18/00 428/659
2007/0163685 A1 7/2007 Kusumi et al.
(Continued)

FOREIGN PATENT DOCUMENTS

CN 103361588 A 10/2013
CN 104755646 A 7/2015
(Continued)

OTHER PUBLICATIONS

International Search Report and Written Opinion for International Application No. PCT/EP2022/057164 mailed May 27, 2022.
(Continued)

*Primary Examiner* — Seth Dumbris
(74) *Attorney, Agent, or Firm* — RMCK Law Group PLC

(57) ABSTRACT

The present disclosure relates to a hot-dip-coated steel sheet having a Zn—Mg—Al coating which includes aluminum at between 0.1 and 8.0 wt %, magnesium at between 0.1 and 8.0 wt %, the balance being zinc and unavoidable impurities, wherein the coating comprises zinc grains and further phases of magnesium and/or aluminum and also eutectic structures including at least intermetallic zinc-magnesium phases, wherein a native oxide layer is formed on the coating. In accordance with the present disclosure, the coating beneath the native oxide layer has an area fraction of at least 35% in which there is an average nanohardness of at least 4 GPa.

15 Claims, 4 Drawing Sheets

(56) References Cited

U.S. PATENT DOCUMENTS

Figure 1:
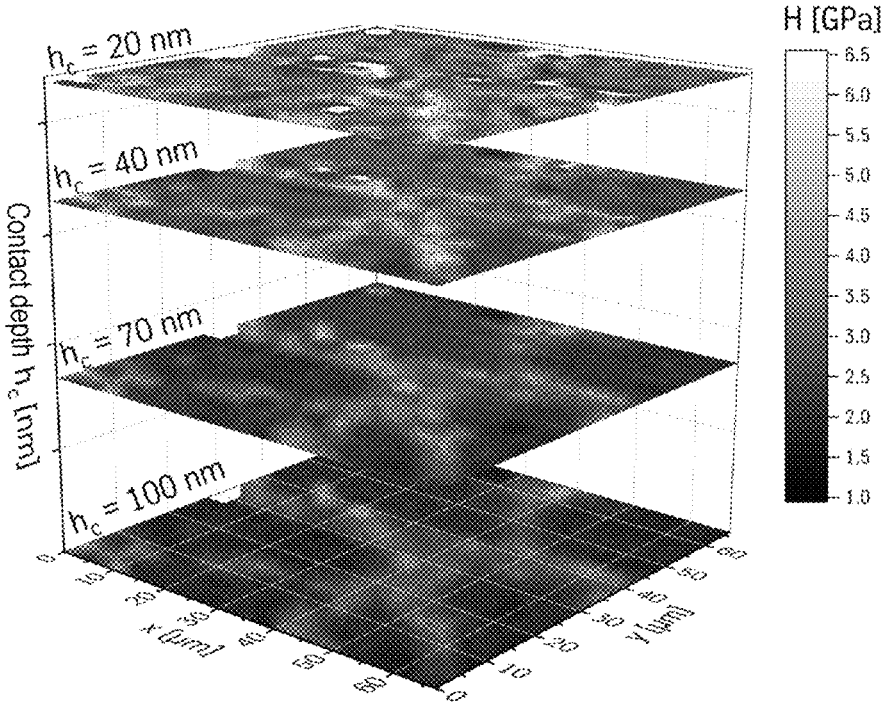

| | | | | |
|---|---|---|---|---|
| 2013/0183541 | A1* | 7/2013 | Kim | B32B 15/013 427/349 |
| 2014/0048181 | A1* | 2/2014 | Banik | C23C 28/321 148/318 |
| 2015/0225831 | A1 | 8/2015 | Riener et al. | |
| 2018/0320260 | A1* | 11/2018 | Oh | C23C 2/20 |
| 2019/0010595 | A1 | 1/2019 | Oh et al. | |
| 2020/0002798 | A1* | 1/2020 | Tokuda | C23C 2/40 |
| 2021/0010123 | A1 | 1/2021 | Sohn et al. | |

FOREIGN PATENT DOCUMENTS

| | | | |
|---|---|---|---|
| CN | 107099748 | A | 8/2017 |
| CN | 110983224 | A | 4/2020 |
| CN | 111534777 | A | 8/2020 |
| DE | 102019204224 | A1 | 10/2020 |
| EP | 2474649 | A1 | 7/2012 |
| EP | 3464662 | B1 | 5/2020 |
| WO | 2020193637 | A1 | 10/2020 |

OTHER PUBLICATIONS

Monojit Dutta et al., "Morphology and properties of hot-dip Zn—Mg and Zn—Mg—Al alloy coatings on steel sheet", Surface and Coatings Technology, Dec. 25, 2010.

Prior art cited in German Office Action for DE Application No. 102021107873.3.

DeBruyucker, E. et al., "Experimental study and microstructure simulation of Zn—Al—Mg coatings", La Revue de Metallurgie, Jul.-Aug. 2005.

Galvatech 2011—Opening Lectures.

Nozahic, F., et al., "Quantitative Mapping of Nanoscale Mechanial Properties of Zn—AL and Zn—Al—Mg Coatings on Steel Sheet by Nanoindentation", Galvatech 2020.

Reiner, C.K., et al. "Nano-Characterisation of the Surface of HDG Zn—Al—Mg-Coated Steel Sheets", Center for Surface- and Nanoanalytics, Linz, Austria.

Search Report for CN Application No. 202280025667 mailed May 28, 2025.

Third Party Objection for EP Application No. 22707072.7 mailed Jun. 10, 2025.

* cited by examiner

HOT-DIP GALVANISED STEEL SHEET

CROSS-REFERENCE TO RELATED APPLICATIONS

This application is a 371 U.S. National Stage of International Application No. PCT/EP2022/057164 filed Mar. 18, 2022 which claims the benefit of German Patent Application No. 10 2021 107 873.3 filed Mar. 29, 2021. The disclosures of each of the above applications are incorporated herein by reference in their entirety.

The invention relates to a hot-dip-coated steel sheet having a Zn—Mg—Al coating.

In a conventional production of Zn—Mg—Al coatings on steel sheets, during and after the establishment of the coating thickness, blowing of the coating while still in liquid-melt form is accompanied by cooling of the coating and hence by crystallization. This process is accompanied by formation primarily of zinc crystals surrounded by magnesium-rich and aluminum-rich phases; cf. CN 110983224 A. During the solidification of zinc-rich Zn—Mg—Al melts, there are local differences in the extent to which, between, above and below the zinc grains precipitated primarily, binary (zinc and intermetallic zinc-magnesium phases) or ternary (zinc, aluminum and intermetallic zinc-magnesium phases) eutectic phases are formed. These eutectic phases are composed of intermetallic phases and pure metals, meaning that as well as the intermetallic phase, these eutectic phases additionally comprise (secondary) zinc grains and possibly aluminum phases (aluminum grains). These secondary zinc grains must not be confused with the zinc grains precipitated primarily, since by comparison with the primary zinc grains they have a volume which is smaller by several orders of magnitude. Whereas the primary zinc grains may have a diameter of in some cases over 30 μm, the diameter of the secondary zinc grains in the eutectic phases is generally up to 3 μm. Furthermore, these secondary phases are precipitated during the solidification of the eutectic. The eutectic is precipitated as the last phase from the melt. Hypo- or hyper-eutectic phases are eutectic which forms surrounded either by the alpha- or the beta-component in the binary phase diagram (left or right of the eutectic composition of the melt). The layer structure of a Zn—Mg—Al coating has an accumulation of eutectic phases surrounding the zinc grains, these phases not being surface-covering but being distributed over the entire surface. The eutectic and the eutectic phases are magnesium-rich phases. The accumulation of eutectic phases distributed over the entire surface may be on average up to 30%.

In general, the addition of magnesium to the melt produces an improvement in the corrosion resistance, and also a reduced tool wear in the course of the forming operation. In the prior art, the improved corrosion behavior is attributed to the microstructure of the eutectic phases in the coating. Decisive in this context substantially are dense eutectic structures consisting of zinc phases, zinc-magnesium (MgZn2 and/or Mg2Zn11) and optionally of aluminum phases, so that layered double hydroxides are formed, consisting of aluminum hydroxides and magnesium hydroxides, which slow down further corrosion. An increase in the area fraction of the dense eutectic phases on the coating provides assurance, correspondingly, of an improvement in the corrosion resistance. The more efficient forming behavior of the Zn—Mg—Al coating, according to the prior art, is not yet fully understood, though it is thought to be based on the altered hardness properties of the phases that form at the coating surface. By comparison with the soft zinc grains, the intermetallic zinc-magnesium (MgZn2 and/or Mg2Zn11) phases located in the eutectic are substantially harder and accordingly more resistant toward wear.

In order to be able to ensure successful attachment of coating material to the coated steel sheets, a further requirement is that the surface of the coating undergo chemical treatment and modification. In the automobile sector, great effort is undertaken, in the context of a phosphating operation, so that a surface covering growth of phosphate crystals can be brought about on a generally hot-dip-coated coating and hence sufficient adhesion and a uniform appearance of the coating material can be achieved. Before crystals are formed, the surface of the hot-dip-enhanced steel sheet is partially "pickled" by the phosphoric acid present in the phosphating solution, resulting in at least partial removal/detachment of the non-reactive oxide layer formed inevitably in the hot-dip coating operation at the surface of the coating. Only when this reaction barrier (oxide layer) is/has been detached is it possible for successful conversion chemistry to be developed; cf., for example, DE 10 2019 204 224 A1 and EP 2474 649 A1.

In the automobile sector, a certain contact time is necessary with the "pickling" medium—ideally, this time ought to be long enough for the oxide layer on the surface of the coating to be ablated substantially completely. If this is not the case, phosphating may be accompanied by spotting, which is attributable to local differences in crystal growth. Even typical automotive adhesion promoters that have been designed for application to metallic coatings are unable, owing to the oxide layer present, to fully develop their effect to a satisfactory end. Defective attachment of such systems is generally accompanied by poorer suitability for adhesive bonding and/or poorer adhesion of coating material. In a worst case, regions in which the oxide layer has not been fully removed by pickling may constitute preferential fracture points. This problem occurs not only in the automobile sector, but also in other sectors where hot-dip-coated steel sheets are used which as well as an outstanding corrosion behavior also have sufficient activatable surface area to be able to be subsequently painted and/or coated with other materials (films, etc.), as for example in the process known as coil coating.

To counteract this disadvantage, there is a need for a hot-dip-coated steel sheet which as well as outstanding corrosion quality also exhibits improved forming behavior by comparison with the prior art.

The object of the invention is to specify a hot-dip-coated steel sheet which displays improved forming behavior.

This object is achieved with the features of claim 1. Further configurations are described in the dependent claims.

The hot-dip-coated steel sheet comprises a Zn—Mg—Al coating which includes aluminum at between 0.1 and 8.0 wt %, magnesium at between 0.1 and 8.0 wt %, the balance being zinc and unavoidable impurities, wherein the coating comprises zinc grains and further phases of magnesium and/or aluminum and also eutectic structures including at least intermetallic zinc-magnesium phases, wherein a native oxide layer is being formed on the coating. In accordance with the invention, the coating beneath the oxide layer has an area fraction of at least 35% in which there is an average nanohardness of at least 4 GPa.

As well as the outstanding corrosion quality due to addition of magnesium, the coating of the invention may exhibit improved forming behavior by comparison with the coatings known from the prior art. Where coating surfaces are subjected to mechanical stresses, there is reduced wear of the forming tool. The reduction in the wear may be explained by a lower friction coefficient by comparison with the prior art, this being in turn closely linked to the hardness of the phases located at the surface, and so it may be assumed that, the harder the phases in the coating and/or at the surface, the lower the friction coefficient and the better the forming properties. The intermetallic zinc-magnesium (MgZn2 and/or Mg2Zn11) phases are harder by a multiple than the soft zinc grains or additional magnesium and/or aluminum phases, and so the eutectic structure at the surface or near the surface (starting from the surface without oxide layer or, when present, starting beneath the oxide layer) down to a depth of not more than 70 nm beneath the surface makes an authoritative contribution to the hardness properties of the coating. The surface-covering formation of the intermetallic zinc-magnesium phases in accordance with the invention makes it possible to ensure the existence of hard phases and hence a low friction coefficient on a substantially surface-covering basis, so that the coating of the invention exhibits even better forming behavior by comparison with the conventional Zn—Mg—Al coating.

Surface-covering or substantially surface-covering refers to an area fraction of at least 35%, more particularly of at least 40%, preferably of at least 45%, more preferably of at least 50%, more preferably still of at least 55%, very preferably of at least 60%.

An average nanohardness of at least 4 GPa at the free surface (without native oxide layer) or beneath the native oxide layer of the coating is present with an area fraction in particular of at least 40%, preferably of at least 45%, more preferably of at least 50%, more preferably still of at least 55%, very preferably of at least 60%.

The area fraction of at least 35% at the free surface (without native oxide layer) or beneath the native oxide layer of the coating may in particular have an average nanohardness of at least 4.5 GPa, preferably of at least 5 GPa, more preferably of at least 5.5 GPa.

The native oxide layer forms during the hot-dip coating operation. The free surface of the coating refers to the surface without native oxide layer or, respectively, after detachment/removal of said layer.

The average nanohardness and also the area fraction are determined using a nanoindenter, an example being the "Hysitron TI Premier" instrument from Bruker. Details of the instrument are available from Bruker or can be retrieved, for example, at the following link: https://www.bruker.com/en/products-and-solutions/test-and-measurement/nanomechanical-test-systems/hysitron-ti-premier-nanoindenter-.html. With the nanoindenter, a particular probe tip, a Berkovich tip (consisting of diamond) for example, is pressed to different depths into a sample for analysis and a hardness can be determined on the basis of the force that is measured, this determination taking place preferably via the evaluation method of Oliver & Pharr (method retrievable at the following link: https://www.sciencedirect.com/topics/engineering/oliver-pharr-method). The sample, in this case the coating, is indented with what is called a "Constant Strain Rate CMX" function (CMX=Continuous Measurement of X, X e.g. hardness, loss modulus or storage modulus). This force function sees the quasistatic force overlaid with a small dynamic force, at 220 Hz for example. This allows depth profiles of mechanical properties to be recorded with high spatial resolution. The strain rate, the rate at which the deformation takes place through the indentation, may be 0.11 $s^{-1}$, for example. For the readjustment of the analyses, however, two measurement series are required:

the first measurement series takes account of the following parameters:

Indent raster with a 12×12 matrix with a spacing of 5.5 μm between the individual points of the matrix, determination of the variables (minimum and maximum force) of the exponentially increasing force curve during indentation between 25 and 10 000 μN with a starting load amplitude (amplitude of force modulation) at 25 μN;

the second measurement series takes account of the following parameters:

Indent spacing with a 20×20 matrix with 3.5 μm spacing, determination of the variables (minimum and maximum force) of the exponentially increasing force curve during indentation between 7.5 and 3000 μN with a starting load amplitude (amplitude of force modulation) at 7.5 μN.

An increased area fraction of intermetallic zinc-magnesium phases and/or the multiplication/increase of these intermetallic phases in the coating may be brought about in a variety of ways. Firstly, particularly as a function of the cooling parameters during the solidification of the liquid-melt coating, influence may be exerted on the phase structure in the Zn—Mg—Al coating. This may mean that at the surface and close to the surface, within a depth of up to 70 nm and even deeper, in the solidified coating, rather than predominantly large, soft zinc grains, it is now the eutectic structures that are able to form to an increased extent, in the form of hard, intermetallic zinc-magnesium (MgZn2 and/or Mg2Zn11) phases. At least with magnesium contents of up to 4.0 wt % in the coating, at an increased cooling rate of around 20 K/s or more for solidifying the liquid-melt coating on the steel sheet, this measure may result in multiplication of the hard intermetallic phases in the coating. At magnesium contents of between 4.0 and 8.0 wt %, as well as a higher magnesium content, there may well be a multiplication of the intermetallic phases in the coating, in conjunction with a standard cooling process; in order to ensure this, however, higher cooling rates must be borne in mind nevertheless, even with high magnesium contents. For example, even at coating thicknesses of 7 μm or more, relatively large, primary zinc grains precipitate initially from the melt, form islands, and are "encircled" by a flow of, or "flooded" with, the remaining liquid eutectic, leading to increased formation of eutectic structures at the surface.

The improved or positive corrosion behavior of the coating of the invention is attributable to two phenomena: 1.) the magnesium in the intermetallic zinc-magnesium phases sacrifices itself, owing to its baser properties by comparison with zinc; 2.) as a result of the increased area fraction of the intermetallic zinc-magnesium phases, a corrosion barrier is formed which slows down the progressing corrosion.

A steel sheet is a flat steel product in strip form or in sheet/blank form. It has a lengthwise extent (length), a transverse extent (width) and a vertical extent (thickness). The steel sheet may be a hot strip (hot-rolled steel strip) or cold strip (cold-rolled steel strip) or may have been produced from a hot strip or from a cold strip.

The thickness of the steel sheet is for example 0.5 to 4.0 mm, more particularly 0.6 to 3.0 mm, preferably 0.7 to 2.5 mm.

Impurities present in the coating may be elements such as bismuth, zirconium, nickel, chromium, lead, titanium, manganese, silicon, calcium, tin, lanthanum, cerium, iron in amounts individually or cumulatively of up to 0.4 wt %.

Further advantageous configurations and developments are apparent from the description hereinafter. One or more features from the claims, the description and the drawing may be linked with one or more other features therefrom to form further configurations of the invention. It is also possible for one or more features from the independent claims to be linked by one or more other features.

According to one configuration, the coating in a depth of 20 nm beneath the oxide layer has an area fraction of at least 35% in which there is an average nanohardness of at least 3 GPa, more particularly of at least 3.5 GPa, preferably of at least 4 GPa, more preferably of at least 4.2 GPa. The average nanohardness of at least 3 GPa, more particularly of at least 3.5 GPa, preferably of at least 4 GPa, more preferably of at least 4.2 GPa in a depth of 20 nm beneath the surface of the coating may be represented with an area fraction in particular of at least 40%, preferably of at least 45%, more preferably of at least 50%, more preferably still of at least 55%. If there is no native oxide layer present or if this layer has been removed, the depth is determined from the (free) surface of the coating.

According to one configuration, the coating in a depth of 40 nm beneath the oxide layer has an area fraction of at least 35% in which there is an average nanohardness of at least 2.5 GPa, more particularly of at least 3 GPa, preferably of at least 3.2 GPa, more preferably of at least 3.4 GPa. The average nanohardness of at least 2.5 GPa, more particularly of at least 3 GPa, preferably of at least 3.2 GPa, more preferably of at least 3.4 GPa in a depth of 40 nm beneath the surface of the coating may be represented with an area fraction in particular of at least 40%, preferably of at least 45%, more preferably of at least 50%, more preferably still of at least 55%. If there is no native oxide layer present or if this layer has been removed, the depth is determined from the (free) surface of the coating.

According to one configuration, the coating in a depth of 70 nm beneath the oxide layer has an area fraction of at least 35% in which there is an average nanohardness of at least 2 GPa, more particularly of at least 2.2 GPa, preferably of at least 2.4 GPa, more preferably of at least 2.6 GPa. The average nanohardness of at least 2 GPa, more particularly of at least 2.2 GPa, preferably of at least 2.4 GPa, more preferably of at least 2.6 GPa in a depth of 70 nm beneath the surface of the coating may be represented with an area fraction in particular of at least 40%, preferably of at least 45%, more preferably of at least 50%, more preferably still of at least 55%. If there is no native oxide layer present or if this layer has been removed, the depth is determined from the (free) surface of the coating.

The composition of the coating may be implemented differently according to requirement and intended use. In the coating, as well as zinc and unavoidable impurities, there are additional elements such as aluminum with a content of between 0.1 and 8.0 wt % and magnesium with a content of between 0.1 and 8.0 wt %. If improved corrosion control is envisaged, the coating additionally comprises magnesium with a content of at least 0.3 wt %. In particular; the coating includes aluminum and magnesium with in each case at least 0.5 wt %, in order to be able to provide an improved cathodic protection effect. In the coating, aluminum and magnesium are preferably limited to not more than 3.5 wt % in each case. With particular preference, magnesium is present in the coating at between 1.0 and 2.5 wt %.

According to one embodiment, the coating has a thickness of between 2 and 20 μm, more particularly between 4 and 15 μm, preferably between 5 and 12 μm.

The hot-dip-coated steel sheet may undergo skin-pass rolling. Skin-pass rolling impresses a surface structure into the coating, which may be a deterministic surface structure, for example. Deterministic surface structure more particularly refers to regularly recurring surface structures, which have a defined shape and/or configuration or dimensioning. Also included here in particular are surface structures having a (quasi)stochastic appearance, being composed of stochastic shape elements with a recurring structure. Alternatively, the introduction of a stochastic surface structure is also conceivable.

The high density and/or high area fraction of the hard intermetallic zinc-magnesium phases is beneficial to the corrosion behavior and, after surface modification of the coating, in the context of treatment with an inorganic acid, for example, may have a surface morphology which achieves a series of advantages. Firstly, treatment with an inorganic acid is able not only to free the surface of the coating entirely of the native oxide layer, but also to ablate the coating beneath the oxide layer with a depth of at least 5 nm or more. The inorganic acid used may be selected from the group containing or consisting of: $H_2SO_4$, HCl, $HNO_3$, $H_3PO_4$, $H_2SO_3$, $HNO_2$, $H_3PO_3$, HF, or a mixture of 2 or more of these acids, as an aqueous solution. An aqueous solution of an inorganic acid may be used with a pH of between 0.01 and 2. In particular, the coating may be wetted with the aqueous solution of an inorganic acid for between 0.5 and 600 s and/or at a temperature of 10 to 90° C. After the corresponding acid treatment, the exposed hard intermetallic zinc-magnesium phases at the surface of the coating, based on a scan region of 5×5 $\mu m^2$, have a developed boundary layer ratio Sdr of at least 5.5%, more particularly at least 6%, preferably at least 7%. Conversely, the exposed zinc grains at the surface have only a developed boundary layer ratio Sdr of 5% or less. The Sdr (developed boundary layer ratio) is a calculation of the ratio of the true surface to the planar measurement face and is therefore a measure of the roughness of the surface, determined by atomic force microscope (AFM). AFM can also be used to determine the average roughness of the surface of the coating of the exposed hard intermetallic zinc-magnesium phase, which is at least 7.5 nm. In particular, the average roughness of the hard intermetallic zinc-magnesium phases may be at least 7.9 nm, preferably at least 8.4 nm.

According to one configuration, the hot-dip-coated steel sheet is phosphated. Phosphating is common practice. In connection with the coating of the invention, however, a surface-coveringly homogeneous phosphate layer is formed, where the zinc phosphate crystals have a size of up to 3 μm, which differ from one another on average by up to 20%, and which in particular have the same orientation.

In the text below, specific configurations of the invention are elucidated in more detail with reference to the drawing. The drawing and accompanying description of the resulting features should not be read as being limiting on the respective configurations, instead serving to illustrate exemplary configuration. Furthermore, the respective features may be utilized, with one another and also with features from the description above, for possible further developments and improvements of the invention, especially in the context of additional configurations which are not represented.

Figure 2:
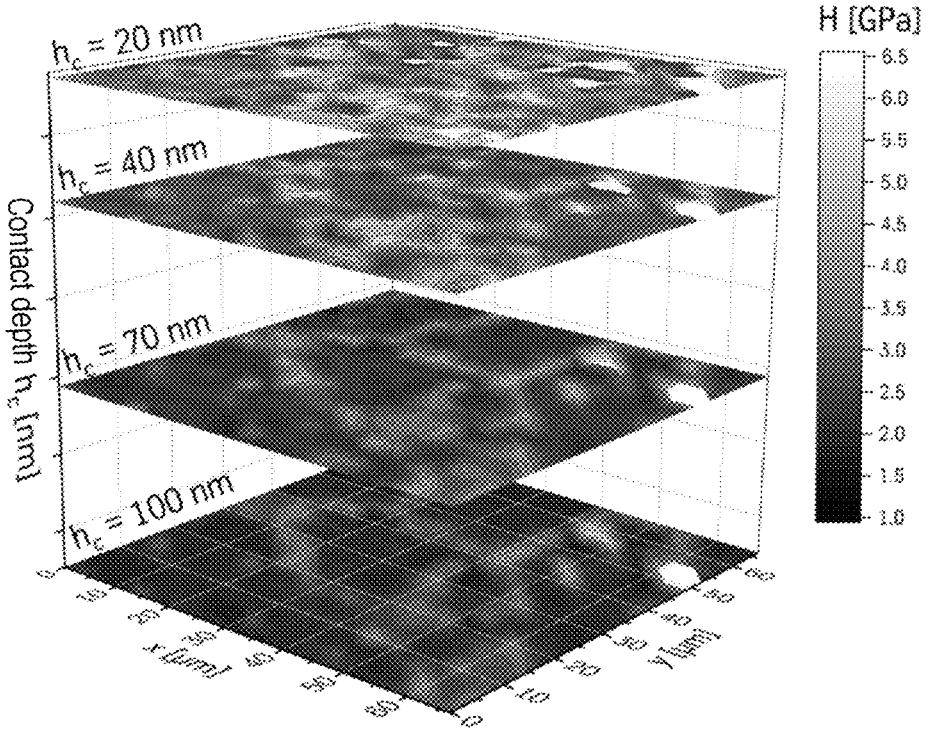
Figure 3:
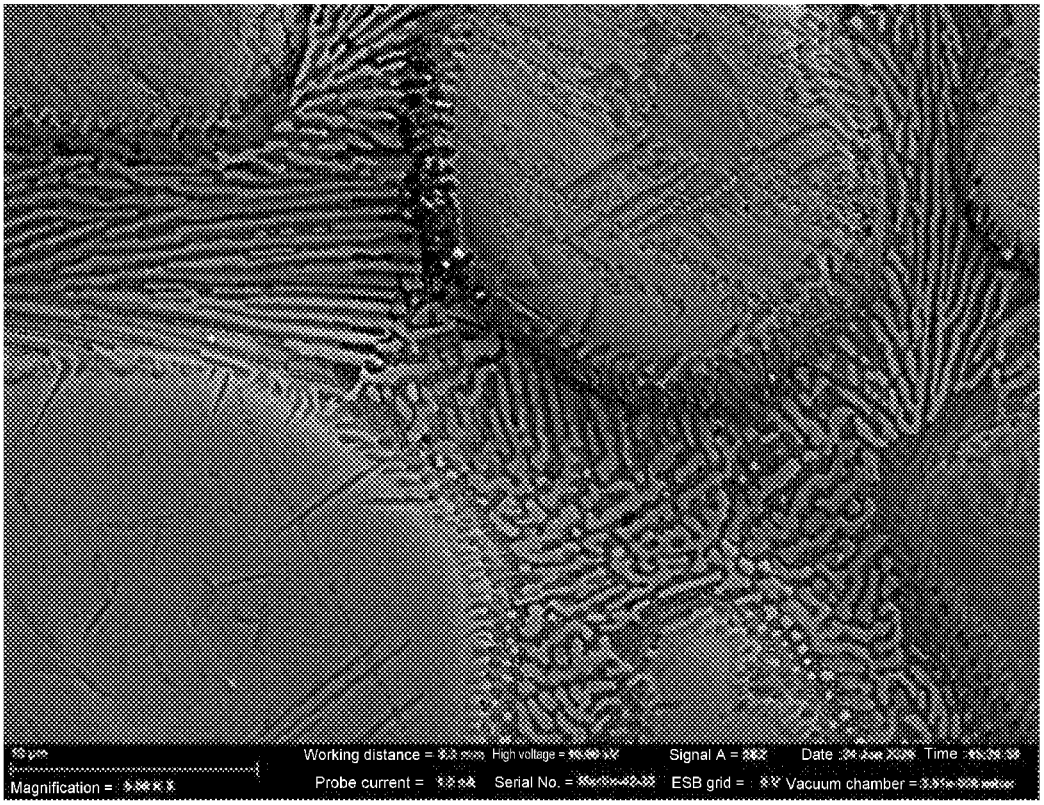
Figure 3:
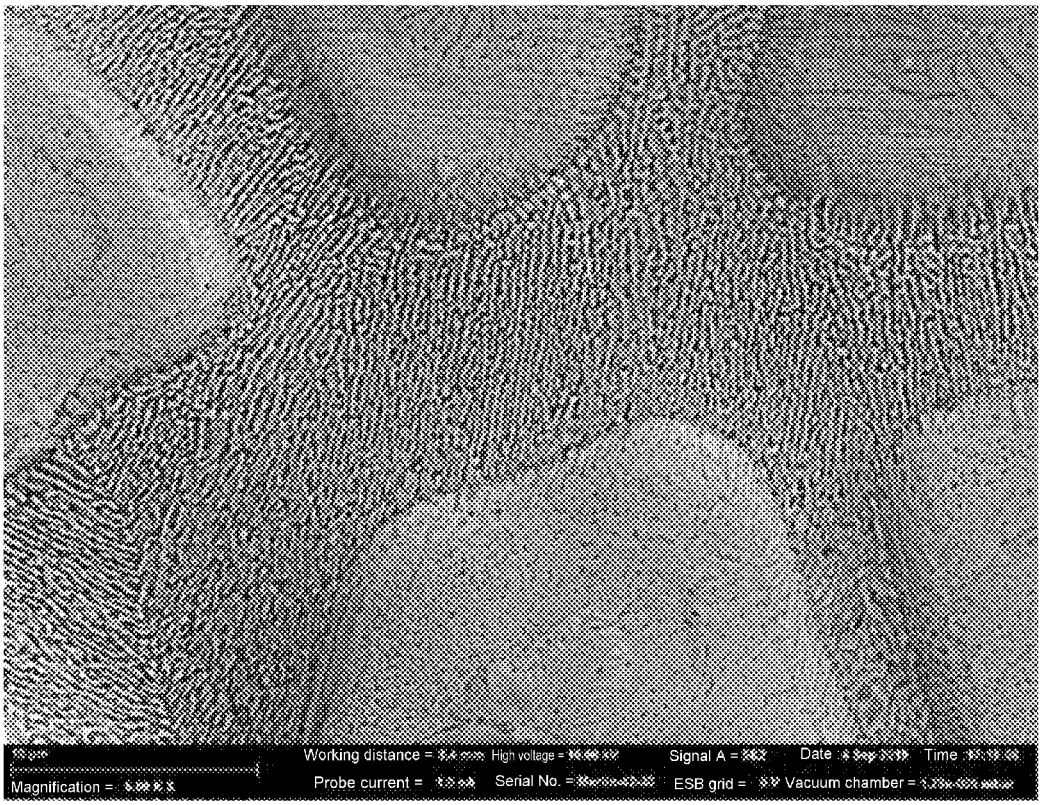
Figure 3:
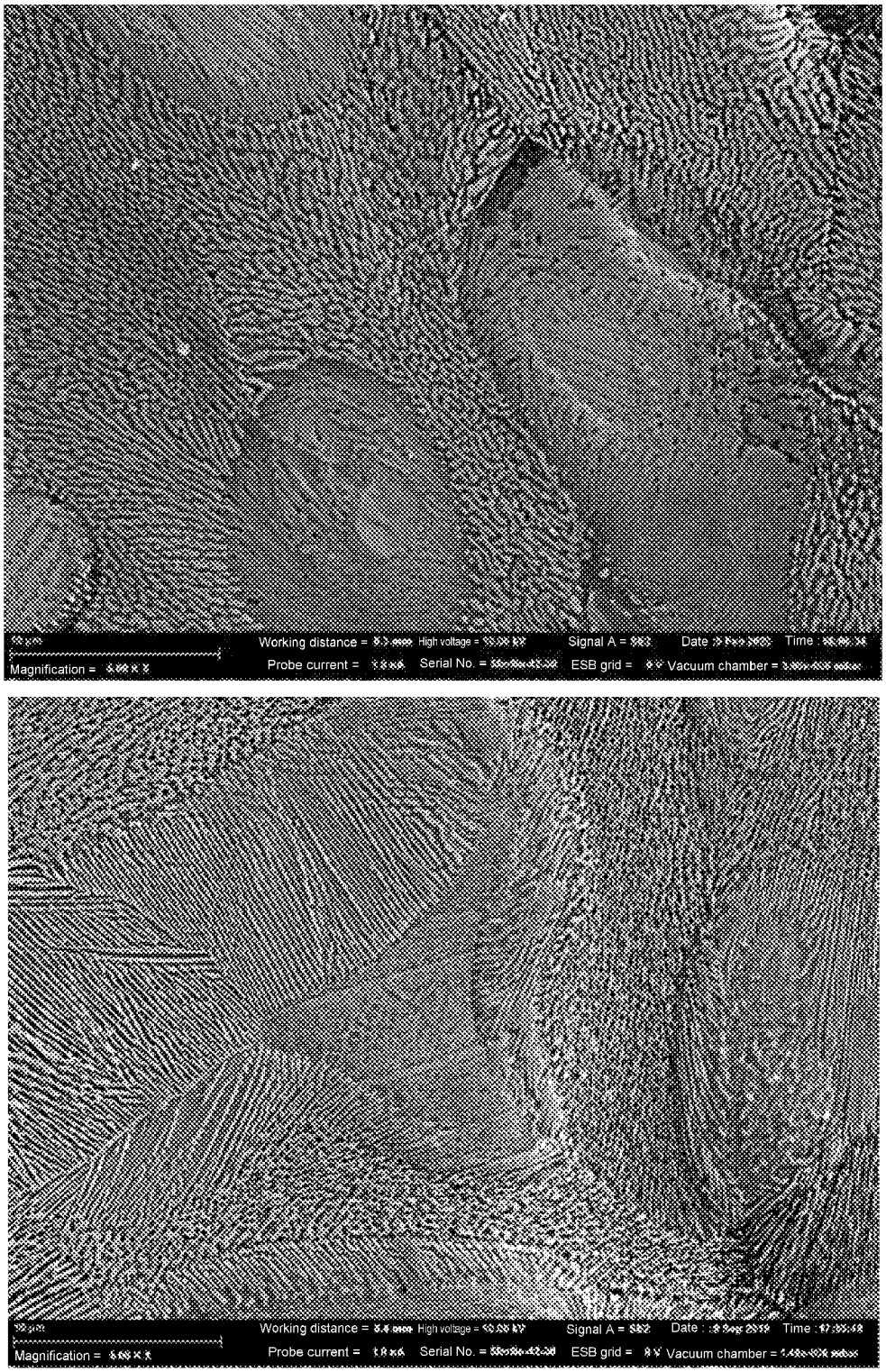

In the drawing,

FIG. 1) shows nanoindenter-generated hardness mappings in a depth of 20 nm, 40 nm and 70 nm within a standard Zn—Mg—Al coating, FIG. 2) shows nanoindenter-generated hardness mappings in a depth of 20 nm, 40 nm and 70 nm within a standard Zn—Mg—Al coating according to one inventive embodiment, and FIG. 3) shows respective SEM micrographs of the surface before and after treatment with an inorganic acid for a standard Zn—Mg—Al coating, left-hand images, and respective SEM micrographs of the surface before and after treatment with an inorganic acid of a Zn—Mg—Al coating according to one inventive embodiment, right-hand images.

Samples of a conventional steel sheet of grade DC04 with a thickness of 0.7 mm were coated in the laboratory with a Zn—Mg—Al coating in a hot-dip simulator, with one cohort of the samples being passed through a first melt bath with Al=1.8 wt %, Mg=1.4 wt %, balance zinc and unavoidable impurities, and the other cohort of the samples through a second melt bath with Al=5.4 wt %, Mg=4.8 wt %, balance zinc and unavoidable impurities. The samples were withdrawn from the melt bath and passed to a stripping apparatus, which acted on both sides on the liquid melt on the samples and stripped off superfluous melt, with a gas stream adjusted in the stripping apparatus, such that after the solidification of the coating the thickness on all the samples was 7 μm. The coating of the samples as a result of the first melt had a composition of Al=1.6 wt % and Mg=1.1 wt %, balance zinc and unavoidable impurities. The coating of the samples as a result of the second melt had a composition of Al=4.6 wt % and Mg=4.1 wt %, balance zinc and unavoidable impurities. Stripping took place in an inert atmosphere with 5% H2, balance N2 and unavoidable constituents, and the stripping gas used was N2. The cohort of the samples (1) which had passed through the first melt was cooled conventionally by the inert atmosphere and, owing to the acting gas stream, with a cooling rate of around 7° C./s. The other cohort of the samples (2) which had passed through the first melt was cooled actively with a cooling rate >20° C./s. Analogously, a cohort of the samples (3) from the second melt was cooled conventionally, and the other cohort of the samples (4) was cooled at a cooling rate >20° C./s.

Formed on all the samples (1) to (4), on the surface of the coating, was a native (magnesium-rich and aluminum-rich) oxide layer which on average for all the samples (1) to (4) was determined at around 8 nm via x-ray photoelectron spectroscopy, independently of the composition of the coating and of the cooling rate.

The various samples (1) to (4) were indented using a "Hysitron TI Premier" nanoindenter from Bruker. The analysis was conducted as already described above. The result was a locationally resolved and depth-resolved representation (nanoindentation), referred to as hardness mappings, in a depth of 20 nm, 40 nm and also 70 nm beneath the native oxide layer, over an analyzed area of 65×65 $\mu m^2$ of the local nanohardness; cf. FIG. 1 for a representation on average of the measured samples (1) and FIG. 2 for a representation on average of the measured samples (2). In terms of result, samples (3) and (4) were situated in the same order of magnitude as the results for samples (2). Using the nanoindenter and the Oliver & Pharr evaluation method, therefore, it is possible to determine the average nanohardness and the corresponding area fraction accordingly, generally over an area of 65×65 $\mu m^2$, as a function of location and depth.

Owing to the structure of the different phases within the coating, an increase in hardness through multiplication of the hard intermetallic zinc-magnesium phases can be ensured in the coating of the invention, this increase in hardness being manifested positively in turn in the corrosion and forming properties. The average nanohardness of at least 3 GPa in a depth of 20 nm beneath the native oxide layer of the coating is represented with an area fraction of at least 35%. In a depth of 40 nm beneath the native oxide layer of the coating, the coating has an area fraction of at least 35% in which there is an average nanohardness of at least 2.5 GPa. Further, in a depth of 70 nm beneath the oxide layer of the coating, the coating has an area fraction of at least 35% in which there is an average nanohardness of at least 2 GPa. In this regard, compare implementations in the corresponding planes/depths in FIGS. 1 and 2. Very readily apparent is the increase in the area fraction with an average nanohardness of at least 4 GPa in a depth of 20 nm for the samples (2) in FIG. 2, in comparison to the area fractions in the depth of 20 nm for the samples (1) in FIG. 1.

Samples (1) to (4) underwent further investigation by being treated at their surfaces with an inorganic acid under laboratory conditions. Here, the samples were degreased with alkaline cleaner and then immersed for 5 s in a solution with 12 ml/l sulfuric acid which had a temperature of 20° C. This was followed by rinsing with water and isopropanol. The entire experiments were conducted under standard air atmosphere. SEM micrographs were used to capture the conditions before and after the treatment with the inorganic acid on samples (1) and (2)—see FIG. 3—with the result that even in the condition before the acid treatment (micrographs in FIG. 3 top, sample (1) on the left and sample (2) on the right) in accordance with the invention there is a multiplication and, in conjunction therewith, a higher fraction of hard intermetallic zinc-magnesium (MgZn2 and/or Mg2Zn11) phases in evidence, with a relatively fine eutectic structure, top right-hand micrograph in FIG. 3, by comparison with the standard, top left-hand micrograph in FIG. 3. Going hand in hand with this, there is also a reduction in evidence in the soft zinc grains (Zn) by comparison with the prior art.

In the acidic medium, however, the magnesium in the intermetallic zinc-magnesium phases dissolves preferentially, and so such acid treatment of the coating of the invention leaves behind a comparatively more aluminum-rich surface. The aluminum at the surface of the coating, moreover, has the advantage that it is more readily soluble by alkaline process media such as cleaners or adhesives and hence allows the surface of the coating to be activated more effectively by such process media.

The treatment of the surface with an inorganic acid therefore has the effect, firstly, of chemically removing the original native (magnesium-rich and aluminum-rich) oxide layer, and secondly of dissolving parts of the underlying intermetallic zinc-magnesium phases from the eutectic; see bottom micrographs in FIG. 3. This leads to a marked roughening of the surface in the region of the intermetallic zinc-magnesium phases (in the nanometer range) and is accompanied by a corresponding growth of surface which is reflected in turn in improved keying of coating materials/adhesives at the surface and also, generally, in improved reactivity; see invention in the bottom right-hand micrograph in comparison to the standard in the bottom left-hand micrograph in FIG. 3. As a result of the corresponding surface-covering occupation (area fraction at least 35% or more) with eutectic phases, the chemical treatment and the associated enlargement in area on the surfaces of the coatings of the invention are much higher than conventional surfaces with less eutectic phases. The acid-treated eutectic at the surface of the coating has an average roughness of at least 7.5 nm, measured by means of AFM. The average roughness of the acid-treated eutectic at the surface of the conventional coating is less than 4.9 nm.

The higher area fraction of the eutectic, more particularly of the intermetallic zinc-magnesium phases and of the relatively fine microstructure—see right-hand micrographs in FIG. 3—improve the corrosion control mechanism in that it allows the surface-covering formation of an even denser corrosion film. The demonstration of the trend toward improved corrosion properties was investigated in different electrolytes (NaCl solution, borate solution), and accordingly it was possible to observe that there was a trend toward lower corrosion propensity with regard to the surface of the coating of the invention. Factors suggesting this are a lower corrosion potential and also a lower limiting current density for oxygen diffusion, relative to the borate buffer.

The invention claimed is:

1. A hot-dip-coated steel sheet having a Zn—Mg—Al coating which includes aluminum at between 0.1 and 8.0 wt %, magnesium at between 0.1 and 8.0 wt %, the balance being zinc and unavoidable impurities, wherein the Zn—Mg—Al coating comprises zinc grains and further phases of magnesium and/or aluminum and also eutectic structures including at least surface-covering intermetallic zinc-magnesium phases comprise $Mg_2Zn_{11}$, wherein the Zn—Mg—Al coating comprises a native oxide layer formed on the Zn—Mg—Al coating, and a coating portion beneath the native oxide layer having an area fraction of at least 35% in which there is an average nanohardness of at least 4 GPa.

2. The steel sheet as claimed in claim 1, wherein the coating portion in a depth of 20 nm beneath the native oxide layer has an area fraction of at least 35% in which there is an average nanohardness of at least 3 GPa.

3. The steel sheet as claimed in claim 1, wherein the coating portion in a depth of 40 nm beneath the native oxide layer has an area fraction of at least 35% in which there is an average nanohardness of at least 2.5 GPa.

4. The steel sheet as claimed in claim 2 wherein the coating portion in a depth of 70 nm beneath the native oxide layer has an area fraction of at least 35% in which there is an average nanohardness of at least 2 GPa.

5. The steel sheet as claimed in claim 4 wherein the Zn—Mg—Al coating includes aluminum and magnesium at in each case between 0.5 and 8.0 wt %.

6. The steel sheet as claimed in claim 5 wherein aluminum and magnesium in the Zn—Mg—Al coating are limited to in each case between 0.5 and 3.5 wt %.

7. The steel sheet as claimed in claim 1 wherein the Zn—Mg—Al coating has a thickness of between 2 and 20 μm.

8. The steel sheet as claimed in claim 7 wherein the Zn—Mg—Al coating bears an impressed deterministic or stochastic surface structure.

9. The steel sheet as claimed in claim 1 wherein hard regions of the surface of the Zn—Mg—Al coating that are exposed after treatment with an inorganic acid have a developed boundary area ratio Sdr of at least 5.5%, based on an AFM scan region of $5\times5\ \mu m^2$.

10. The steel sheet as claimed in claim 1 wherein the steel sheet has a surface-coveringly homogeneous phosphate layer with zinc phosphate crystals of up to 3 μm in size.

11. The steel sheet as claimed in claim 1 wherein the coating portion beneath the native oxide layer has an area fraction of at least 50% in which there is an average nanohardness of at least 4 GPa.

12. The steel sheet as claimed in claim 1 wherein the coating portion beneath the native oxide layer has an area fraction of at least 35% in which there is an average nanohardness of at least 5 GPa.

13. The steel sheet as claimed in claim 1 wherein the coating portion beneath the native oxide layer has an area fraction of at least 35% in which there is an average nanohardness of at least 5.5 GPa.

14. The steel sheet as claimed in claim 5 wherein magnesium in the Zn—Mg—Al coating is present at between 1.0 and 2.5 wt %.

15. The steel sheet as claimed in claim 1 wherein the surface-covering intermetallic zinc-magnesium phases comprise a surface-covering formation having the $Mg_2Zn_{11}$.

* * * * *